US011361925B2

(12) United States Patent
Hoffmann

(10) Patent No.: US 11,361,925 B2
(45) Date of Patent: Jun. 14, 2022

(54) RELAY

(71) Applicant: Phoenix Contact GmbH & Co. KG, Blomberg (DE)

(72) Inventor: Ralf Hoffmann, Berlin (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 74 days.

(21) Appl. No.: 17/050,062

(22) PCT Filed: Apr. 10, 2019

(86) PCT No.: PCT/EP2019/059108
§ 371 (c)(1),
(2) Date: Oct. 23, 2020

(87) PCT Pub. No.: WO2019/206638
PCT Pub. Date: Oct. 31, 2019

(65) Prior Publication Data

US 2021/0074500 A1 Mar. 11, 2021

(30) Foreign Application Priority Data

Apr. 24, 2018 (DE) ..... 10 2018 109 864.2

(51) Int. Cl.
*H01H 50/58* (2006.01)
*H01H 50/18* (2006.01)
*H01H 50/36* (2006.01)

(52) U.S. Cl.
CPC ..... *H01H 50/58* (2013.01); *H01H 50/18* (2013.01); *H01H 50/36* (2013.01); *H01H 2235/01* (2013.01)

(58) Field of Classification Search
CPC ..... H01H 50/58; H01H 50/36; H01H 50/18
(Continued)

(56) References Cited

U.S. PATENT DOCUMENTS 3,418,608 A * 12/1968 Angel ..... H01H 50/58 335/131
4,290,037 A * 9/1981 Inagawa ..... H01H 50/28 335/202

(Continued)

FOREIGN PATENT DOCUMENTS

DE 29 07 594 A1 10/1979
DE 102005051679 A1 2/2007

(Continued)

*Primary Examiner* — Alexander Talpalatski
(74) *Attorney, Agent, or Firm* — Holland & Hart LLP

(57) ABSTRACT

A relay for assembling in terminal blocks includes an electromagnetic drive arrangement including an armature, an armature bearing spring, and a yoke. The armature is at least partially spaced from the yoke, is movably mounted, and is reduces the distance between the yoke and the armature under an effect of an electromagnetic force. The armature bearing spring applies a spring force counteracting the electromagnetic force. The yoke interacts electromagnetically with the armature to apply the electromagnetic force. A contact spring has a first contact surface and a contact arm, and the contact arm is spaced from the first contact surface and comes into contact with the first contact surface via a pressure force acting to establish an electrical connection between the first contact surface and the contact arm. An insulating element electrically isolates the armature from the contact arm and actuates the contact arm to produce the pressure force.

15 Claims, 8 Drawing Sheets

(58) Field of Classification Search
USPC ..... 335/78, 129
See application file for complete search history.

(56) References Cited

U.S. PATENT DOCUMENTS

| | | | | | |
|---|---|---|---|---|---|
| 4,339,734 | A * | 7/1982 | Minks | H01H 51/2236 | 335/78 |
| 4,383,232 | A * | 5/1983 | Richert | H01H 50/042 | 335/129 |
| 6,674,348 | B2 * | 1/2004 | Biecks | H01H 50/08 | 335/78 |
| 6,771,153 | B2 * | 8/2004 | Mochizuki | H01H 50/043 | 335/78 |
| 2013/0278362 | A1 * | 10/2013 | Iwamoto | H01H 1/26 | 335/78 |

FOREIGN PATENT DOCUMENTS

| | | | |
|---|---|---|---|
| EP | 0199119 | A1 | 10/1986 |
| EP | 2 645 386 | B1 | 10/2013 |
| JP | S54-36037 | U | 3/1979 |
| JP | S57163648 | U1 | 10/1982 |
| JP | S58-121522 | A | 7/1983 |
| JP | H03-57129 | A | 3/1991 |
| JP | H07-14489 | A | 1/1995 |

* cited by examiner

RELAY

CROSS-REFERENCE TO RELATED APPLICATIONS

The present application is the national phase entry under 35 U.S.C. 371 of International Patent Application No. PCT/EP2019/059108 by Hoffmann, entitled "RELAY," filed Apr. 10, 2019; and claims the benefit of German Patent Application No. 10 2018 109 864.2 by Hoffmann, entitled "RELAIS," filed Apr. 24, 2018, each of which is assigned to the assignee hereof and is incorporated by reference in its entirety.

FIELD OF THE DISCLOSURE

The present disclosure relates to a relay for assembling in terminal blocks with a reduced installation space.

BACKGROUND

A relay can have electrical connection contacts which have a minimum spacing in relation to the minimum insulation distances to be observed. The electrical connection contacts of the relay are typically arranged in a row according to the minimum insulation distances. It may be necessary to prevent the insulation distances from falling below the minimum insulation distances. Correspondingly, an increase in the packing density of relays arranged next to one another, in particular in a terminal block, can be achieved by reducing an width perpendicular to the row of electrical connection contacts. Conventional switching arrangements within a relay have, for example, a minimum width of 5-6 mm and can be used for terminal blocks with a minimum block width of 6 mm. Accordingly, there is the disadvantage that these relays are not suitable for terminal blocks with an width of 3 mm and it may not be possible to use these terminal blocks.

SUMMARY

It is the object of the present disclosure to provide a more efficient relay which, in particular, has a magnet system that takes up less installation space.

This object is achieved by the features of the independent claim. Advantageous examples are the subject matter of the dependent claims, the description and the accompanying figures.

The present disclosure is based on the knowledge that the above object is achieved by a relay comprising an armature, an armature bearing spring and a yoke, wherein the armature and the yoke are arranged parallel to a support plane and wherein the armature is held in an actuating direction perpendicular to the support plane on the yoke by means of the armature bearing spring. The armature can interact electromagnetically with the yoke in order to move the armature at least partially along the actuation direction. With the movement of the armature, a mechanical switching contact can be opened or closed via a coupling with an insulating element. The switching contact can be switched in a direction parallel to the actuation direction.

According to a first aspect, the disclosure relates to a relay for assembling in terminal blocks with reduced installation space. The relay comprises an electromagnetic drive arrangement which comprises an armature, an armature bearing spring and a yoke. The armature is at least partially spaced from the yoke, is movably mounted and is adapted to reduce a distance between the yoke and the armature under the effect of an electromagnetic force acting on the armature. Furthermore, the armature bearing spring is adapted to apply a spring force to the armature, said spring force counteracting the electromagnetic force. The yoke is adapted to interact electromagnetically with the armature in order to apply the electromagnetic force to the armature.

Furthermore, the relay comprises a contact spring which has a first contact surface and a contact arm. The contact arm is arranged at a distance from the first contact surface and is adapted to come to contact with the first contact surface by means of a pressure force acting on the contact arm in order to establish an electrical connection between the first contact surface and the contact arm. Furthermore, the relay comprises an insulating element which is arranged on the armature and lies on the contact arm. The insulating element is adapted to electrically isolate the armature from the contact arm and to actuate the contact arm in order to produce the pressure force which acts on the contact arm by moving the armature.

The armature, the insulating element, the contact arm and the yoke are each arranged parallel to a support plane, and the armature, the insulating element and the contact arm are mounted in an at least partly movable manner perpendicularly with respect to the support plane.

The relay can in particular correspond to a relay with a standardized structural size and/or footprint with which a height, a width, a depth and/or a connection contact arrangement of the relay are defined. For example, the relay can be a narrow network relay (SNR). In particular, the width of the relay can be reduced from 6 mm to 3 mm or 3.5 mm.

The electromagnetic drive arrangement can be adapted to produce a rotation of the armature by absorbing electrical energy, which armature is coupled to the contact spring via the insulating element. Accordingly, the contact arm of the contact spring can be moved in order to interrupt or establish an electrical contact between the contact surface and the contact arm.

The amount of rotation of the armature can be different in relation to the amount of translation of the contact arm, since the insulating element can form a lever with which the translation of the contact arm is increased and/or decreased with respect to the rotation of the armature. Furthermore, an electromagnetic force acting on the armature can be transmitted to the contact arm by means of the insulating element, so that the contact arm acts on the contact surface with a lever force, for example. The lever force can be greater or less than the electromagnetic force.

The contact arm, the insulating element and the armature are advantageously supported without play in order to achieve an efficient transmission of force from the armature to the contact arm. In particular, a coupling between the contact arm and the insulating element can be prestressed by means of a spring force generated by the contact arm. The insulating element can also be firmly connected to the armature, in particular by means of a form-fitting and/or force-fitting connection.

The armature can rest with a first surface on the yoke and a second surface can be spaced from the yoke, so that the distance between the second surface and the yoke forms a working gap, which by means of the rotation of the armature due to the action of the electromagnetic force between the armature and the yoke can be overcome. The armature can overcome the working gap in particular by a tilting movement and/or bending.

The insulating element can, for example, form an extension of the armature, the insulating element in particular being at a greater distance from the first surface than from the second surface of the armature, so that the insulating element covers a greater distance when overcoming the working gap than is defined by the working gap.

In one example, the contact arm is adapted to be elastically deformed when the pressure force acts perpendicular to the support plane in order to generate a spring tension force which counteracts the pressure force.

An elasticity and/or flexibility of the contact arm can be set such that the pressure force with which the insulating element presses on the contact arm is large enough to realize a translation of the contact arm in a direction opposite to the spring tension force, in particular perpendicular to the support plane. The distance that can be overcome by means of the translation of the contact arm corresponds at least to the distance between the contact arm and the first contact surface in order to establish an electrical connection by means of mechanical contact between the contact arm and the first contact surface.

Furthermore, the contact arm can be movably mounted, in particular when the pressure force is acting, it can be mounted rotatably via an axis of rotation or a tilting axis, in order to come to contact with the first contact surface with a turning or tilting movement. In order to release the contact with the first contact surface, the contact arm can be connected to the insulating element, in particular by means of a force-fitting and/or form-fitting connection, so that the contact arm can follow movements of the insulating element in both directions.

In one example, the contact arm is adapted to separate the electrical connection between the contact arm and the first contact surface if the spring tensioning force is greater than the pressure force. This has the advantage that when the electromagnetic force acting between the yoke and the armature decays, the support of the contact arm with the first contact surface can be canceled in order to electrically isolate the contact arm from the first contact surface.

In particular, with the spring tension force, in addition to the spring force which acts on the armature by means of the armature bearing spring, a return movement of the armature from the yoke can be realized with the creation of the working gap between the yoke and armature. As a result of the elastic deformation, the armature can, in addition to the spring force and/or the spring tension force, have a tension which achieves a return of the armature from the yoke.

In one example, the contact arm is arranged perpendicular to the insulating element. As a result, an overall relay length of the relay in the direction of the insulating element or the armature can be reduced. With the perpendicular alignment of the contact arm in the support plane, an electrical connection contact of the contact arm, which can be arranged outside of a relay housing, can be arranged along the alignment of the contact arm. Accordingly, the overall relay length of the relay can only be increased by a width of the contact arm.

Furthermore, a further electrical connection contact of the first contact surface can be led out of the relay housing at least partially parallel to the contact arm. Accordingly, only a width of the further electrical connection contact can contribute to an increase in the overall relay length. In addition, possibly required insulation distances between the connection contacts must be taken into account, which require a minimum distance between the contacts, whereby the minimum distance can contribute to the increase of the overall relay length.

In one example, the yoke is U-shaped and comprises a first yoke leg and a second yoke leg, wherein the armature is at least partially resiliently mounted on the first yoke leg by means of the armature bearing spring and is arranged at a distance from the second yoke leg, and wherein the first yoke leg and the second yoke leg are arranged in the support plane and the armature is arranged perpendicular to the first yoke leg and/or the second yoke leg.

The armature can, for example, lie with the first surface on the first yoke leg and/or the second surface can be aligned with the second yoke leg, so that during the electromagnetic interaction of the armature with the yoke, the armature comes to contact with the second surface on the second yoke leg.

The armature can be force-fittingly attached to the first yoke leg via the armature bearing spring. In particular, the armature bearing spring can be adapted to press the first surface of the armature onto the first yoke leg. The armature bearing spring can also counteract the spring tensioning force of the contact arm if the armature is distanced from the yoke beyond a rest position by means of the spring tensioning force. Accordingly, in this case, the spring force of the armature bearing spring can counteract the spring tension force of the contact arm.

The armature can, for example, come to contact with the respective ends of the first yoke leg and the second yoke leg, or be aligned with the yoke legs. The armature can be arranged flush with the yoke in relation to a relay height of the relay, to which the yoke legs are aligned parallel, or be arranged lower in order to prevent an increase of the height of the relay by the armature.

In one example, the armature is paramagnetic or ferromagnetic in order to, when the magnetic force acts, reduce a distance between the armature and the second yoke leg along a perpendicular axis of the support plane by moving towards the second yoke leg and/or by deformation in the direction of the second yoke leg. This has the advantage that the armature can overcome a working gap between the armature and the second yoke leg in order to actuate the contact spring via the insulating element.

The return movement of the armature can also be achieved by the spring tension force applied by the contact arm and/or by the spring force applied by the armature bearing spring.

In one example, the relay comprises an electromagnetic coil and a coil carrier, wherein the electromagnetic coil is arranged with the coil carrier on the yoke, and wherein the yoke is adapted to penetrate the armature with a magnetic field generated by the electromagnetic coil in order to generate the electromagnetic force. The yoke can in particular form a coil core of the electromagnetic coil, which is penetrated by a magnetic field when a current flows through the electromagnetic coil.

The yoke can be ferromagnetic or paramagnetic, so that the magnetic field can be guided in the yoke. The yoke is advantageously shaped such that a magnetic field strength between the second yoke leg and the armature, in particular on the second surface, can be increased in order to improve the magnetic coupling of the yoke to the armature.

In one example, the coil carrier has a recess parallel to the support plane, in which the electromagnetic coil at least partially engages on the yoke in order to reduce an width perpendicular to the support plane.

This has the advantage that a composite of yoke and electromagnetic coil has a minimal width, so that an width of the relay is advantageously not increased or minimal. The magnetic force that can be generated by the electromagnetic drive arrangement and with which the armature and the yoke can be coupled can depend on the inductance of the electromagnetic coil, the magnetic permeability and/or the alignment to one another and the shape of the armature and the yoke. The inductance of the electromagnetic coil can be proportional to a number of coil windings, with the number of coil windings also increasing the amount of space required for the coil in the direction of the relay width.

Correspondingly, an electromagnetic coupling strength of the armature with the yoke can depend on an width of the yoke. Accordingly, it may be necessary to maximize the electromagnetic coupling strength between the armature and the yoke with a predetermined maximum relay width. It is therefore advantageous to fill as great a width as possible with the yoke and/or the coil windings in the direction of the relay width. Correspondingly, the width of the coil carrier with the recess in the direction of the relay width is minimized, so that the available installation space for the electromagnetic coil or for the yoke can be maximized.

The coil holder can be adapted to hold the electromagnetic coil to the side of the first yoke leg, in particular on the sides of the first yoke leg that are oriented perpendicular to the relay width.

The relay can furthermore comprise a further electromagnetic coil, the electromagnetic coil being arranged on the first yoke leg and the further electromagnetic coil being arranged on the second yoke leg. The electromagnetic coils can be electrically connected to one another in series or in parallel. The coils can be supplied with an electrical signal via two relay connection contacts.

In one example, the contact spring has a second contact surface, wherein the contact arm is arranged on the second contact surface and is adapted to electrically separate the second contact surface from the contact arm under the effect of the pressure force. This has the advantage that the relay can have two closing contacts. In a first switching state, the relay can establish an electrical connection between the first contact surface and the contact arm, and in a second switching state the relay can establish an electrical connection between the second contact surface and the contact arm.

In one example, the contact arm is adapted to restore the electrical connection of the contact arm to the second contact surface after the pressure force has subsided. This has the advantage that the relay is either in the first switching state or in the second switching state, so that in particular the contact arm can be prevented from remaining in a position in which the contact arm makes electrical contact with neither the first contact surface nor the second contact surface.

In one example, the contact arm is oriented perpendicular to the armature in a position direction, the first contact surface being at a smaller distance from the insulating element than the second contact surface along the position direction. This has the advantage that an relay length of the relay can advantageously be reduced. The contact arm can in particular be aligned parallel to the first yoke leg and/or the second yoke leg and enclose a right angle with the insulating element and/or the armature.

The first contact surface and the second contact surface can, in particular, make electrical contact with the contact arm offset from one another. On contact surfaces of the first contact surface and/or the second contact surface with the contact arm, contact points can be provided on the respective contact surface and/or the contact arm which have an width in the direction of the relay width. Accordingly, an offset arrangement of the contact point of the first contact surface with respect to the contact point of the second contact surface prevents the contact points from being arranged one above the other, so that the relay width can advantageously be reduced with this arrangement of the contact points.

In one example, the relay comprises a relay housing which has a shell-shaped receiving niche for receiving the electromagnetic drive arrangement with the insulating element and the contact spring, the contact spring being arranged laterally next to the yoke in order to reduce a relay width of the relay. The relay housing can in particular be adapted to close the relay dust-tight and/or fluid-tight in order to protect the electromagnetic drive arrangement and/or the contact spring from external influences, in particular moisture and/or contamination. The relay can therefore also be used in potentially explosive areas. Furthermore, the relay can be assembled under a protective atmosphere and sealed with the relay housing, so that the protective atmosphere is maintained within the relay housing. The relay can for example be filled with a protective fluid, in particular a protective gas, in order to prevent contact erosion and/or arcing and/or corrosion at the contact points.

The housing can have retaining depressions and latching elements which are adapted to hold components of the electromagnetic drive arrangement and/or the contact spring in the relay housing by means of a form-fit and/or force-fit connection.

In one example, in relation to the relay width, the first contact surface is arranged on a base surface of the relay housing, the contact arm is arranged at a distance above the first contact surface, and the insulating element is arranged above or next to the contact arm. In particular, the contact arm is arranged in a switching direction perpendicular to the support plane above the first contact surface and/or below the second contact surface. The insulating element can in this switching direction come to contact above the contact arm with it or can be connected to it. In order to further reduce the relay width, the insulating element can be connected laterally with the contact arm so as not to protrude beyond the contact arm in the switching direction.

In one example, the contact arm comprises a contact section, a crank section and a fastening section, wherein the first contact surface is arranged on the contact section, and wherein the contact section is connected to the fastening section via the crank section, and wherein the crank section is adapted to position the contact section in relation to the fastening section offset along an axis which is aligned parallel to the relay width, in particular perpendicular to the support plane.

The contact arm, in particular the crank section, can be step-shaped, for example z-shaped or s-shaped, in order to overcome a distance in the direction of the relay height between the second contact surface and the fastening section. Furthermore, the crank section can have a spring element and/or can be adapted to be elastic in order to generate a restoring force when the spring arm is deflected via the insulating element, which resting force drives the contact arm back into a starting position.

The fastening section can be adapted to be fastened to a section receptacle with a rivet, weld, solder, adhesive and/or snap connection. The section receptacle is adapted in particular to be electrically conductive and is connected to a switching contact connection, via which the contact arm can be subjected to an electrical signal.

Furthermore, the offset between the contact section and the offset section achieved by the crank section can in particular be smaller than the relay width. The contact section has the contact points for electrical connection to the first contact area and the second contact area.

In one example, the contact arm has a receiving arm which is formed laterally on the contact section and/or the crank section, the receiving arm being adapted to at least partially receive the insulating element in order to form a form-fit and/or force-fit connection with the insulating element.

This has the advantage that the mechanical connection to the insulating element can be spatially decoupled from the electrical contacting of the contact arm with the first contact surface and/or the second contact surface. Correspondingly, the receiving arm can be arranged in such a way that the available installation space can be optimally used and, in particular, the space requirement (footprint) and/or the relay width of the relay are not increased.

The receiving arm can extend in a quarter circle shape from the contact arm, in particular parallel to the support plane. Furthermore, the receiving arm can have a form-fitting connector, with which the receiving arm can be connected to the insulating element in a form-fitting and/or force-fitting manner. The receiving arm can also form a semicircle, wherein the receiving arm crosses with the contact arm at an apex of the semicircle, so that the contact arm forms a curved, in particular quarter-circle-shaped arm on both sides of the contact arm and parallel to the support plane. The contact arm can be arranged at a distance with respect to the contact section of the contact arm along an axis parallel to the relay height, in order to arrange the contact arm in particular closer to the base plate of the relay housing or closer to a side wall terminating the relay. As a result, the relay width and/or the relay height can advantageously be reduced.

BRIEF DESCRIPTION OF THE DRAWINGS

Further examples are explained with reference to the accompanying figures. They show.

DETAILED DESCRIPTION

Figure 1:
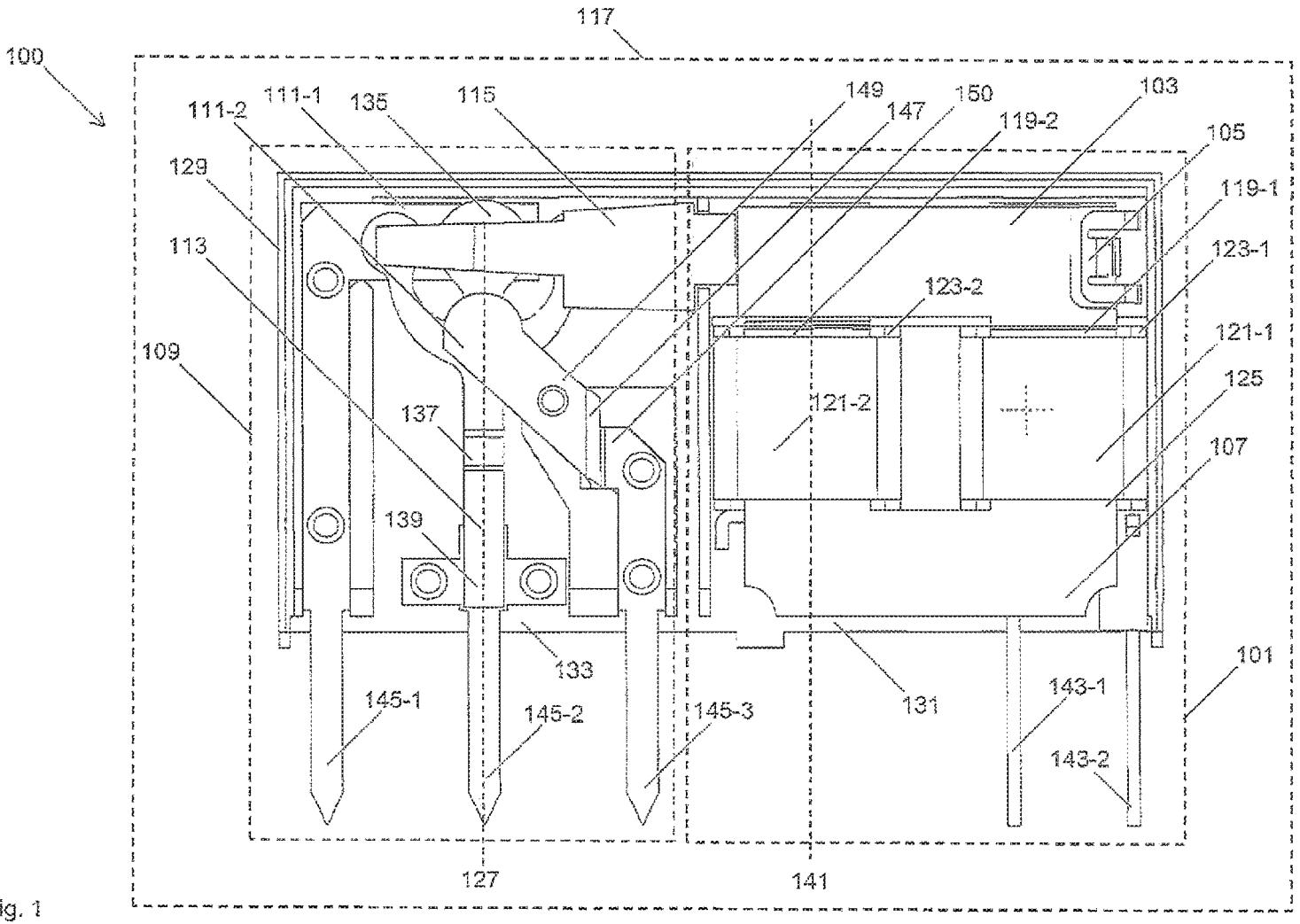
FIG. 1 shows a relay in an example.

FIG. 1 shows a schematic illustration of a relay 100 for assembling in terminal blocks that have reduced installation space. The relay 100 comprises an electromagnetic drive arrangement 101, which comprises an armature 103, an armature bearing spring 105 and a yoke 107. The armature 103 is at least partially spaced from the yoke 107, is movably mounted and is adapted to reduce a distance between the yoke 107 and the armature 103 under the effect of an electromagnetic force acting on the armature 103.

The armature bearing spring 105 is adapted to apply a spring force to the armature 103, which counteracts the electromagnetic force. Furthermore, the yoke 107 is adapted to interact electromagnetically with the armature 103 in order to apply the electromagnetic force to the armature 103.

The relay 100 further comprises a contact spring 109 which comprises a first contact surface 111-1 and a contact arm 113. The contact arm 113 is arranged at a distance from the first contact surface 111-1 and is adapted to come to contact with the first contact surface 111 1 by means of a pressure force acting on the contact arm 113 in order to establish an electrical connection between the first contact surface 111-1 and the contact arm 113.

The relay 100 furthermore comprises an insulating element 115 which is arranged on the armature 103 and lies on the contact arm 113. The insulating element 115 is adapted to electrically isolate the armature 103 from the contact arm 113 and to actuate the contact arm 113 in order to produce the pressure force acting on the contact arm 113 by moving the armature 103. The armature 103, the insulating element 115, the contact arm 113 and the yoke 107 are each arranged parallel to a support plane 117 and the armature 103, the insulating element 115 and the contact arm 113 are mounted in an at least partly moveable manner perpendicularly with respect to the support plane 117.

The contact arm 113 is adapted to be elastically deformed perpendicular to the support plane 117 when the pressure force acts, in order to generate a spring tensioning force which counteracts the pressure force. Furthermore, the contact arm 113 is adapted to separate the electrical connection between the contact arm 113 and the first contact surface 111-1 if the spring tension force is greater than the pressure force. The contact arm 113 is arranged perpendicular to the insulating element 115.

The yoke 107 is U-shaped and comprises a first yoke leg 119-1 and a second yoke leg 119-2, the armature 103 being resiliently mounted on the first yoke leg 119-1 by means of the armature bearing spring 105. The first yoke leg 119-1 and the second yoke leg 119-2 are arranged in the support plane 117 and the armature 103 is arranged perpendicular to the first yoke leg 119-1 and the second yoke leg 119-2.

The relay 100 further comprises two electromagnetic coils 121-1, 121-2 and two coil carriers 123-1, 123-2. The electromagnetic coil 121-1 is arranged with the coil carrier 123-1 on the first yoke leg 119-1 and the further electromagnetic coil 121-2 is arranged with the further coil carrier 123-2 on the second yoke leg 119-2. The yoke 107 is adapted to penetrate the armature 103 with a magnetic field generated by the electromagnetic coil 121-1 in order to generate the electromagnetic force. The coil carriers 123-1, 123-2 each have a recess 125 parallel to the support plane 117, in which the respective electromagnetic coil 121-1, 121-2 engages on the respective yoke leg 119-1, 119-2, in order to reduce a width of the composite consisting of the respective yoke legs 119-1, 119-2, the respective electromagnetic coil 121-1, 121-2 and the respective coil carrier 123-1, 123-2 perpendicular to the support plane 117.

The contact spring 109 comprises a second contact surface 111-2, and the contact arm 113 is arranged on the second contact surface 111-2 and is adapted to electrically separate the second contact surface 111-2 from the contact arm 113 under the effect of the pressure force. The contact arm 113 is also adapted to restore the electrical connection of the contact arm 113 to the second contact surface 111-2 after the pressure force has subsided. Furthermore, the contact arm 113 is oriented perpendicular to the armature 103 in a position direction 127, and the first contact surface 111-1 is at a smaller distance from the insulating element 115 along the bearing direction 127 than the second contact surface 111-2.

The relay 100 further comprises a relay housing 129, which has a shell-shaped receiving recess 131 for receiving the electromagnetic drive arrangement 101 with the insulating element 115 and the contact spring 109. The contact spring 109 is arranged laterally next to the yoke 107 in order to reduce a relay width of the relay 100. With regard to the relay width, the first contact surface 111-1 is arranged on a base surface 133 of the relay housing 129, the contact arm 113 is arranged at a distance above the first contact surface 111-1, and the insulating element 115 is arranged above the contact arm 113.

The contact arm 113 has a contact section 135, a crank section 137 and a fastening section 139, the first contact surface 111 1 being arranged below the contact section 135 and the second contact surface 111-2 being arranged above the contact section 135. The contact section 135 is connected to the fastening section 139 via the crank section 137 and the crank section 137 is adapted to position the contact section 135 offset with respect to the fastening section 139 along an axis which is parallel to the relay width and perpendicular to the support plane 117.

Furthermore the contact arm 113 has a receiving arm 307, which is formed laterally on the contact section 135 and/or the crank section 137, and wherein the receiving arm 307 is adapted to at least partially receive the insulating element 115 in order to establish a form-fitting and/or force-fitting connection with the insulating element 115.

The first contact surface 111-1 and the second contact surface 111-2 are each formed in one piece from an electrically conductive sheet metal blank which has round fastening points, in particular riveting points. The first contact surface 111-1 is L-shaped, with one end of the shorter leg being aligned with the contact arm 113. A switching contact connection 145-1 is formed on the longer leg, which protrudes from the relay housing 129 and is adapted to be inserted into a contact plug in order to apply an electrical signal to the first contact surface 111-1.

The second contact surface 111-2 is shaped at an angle, a first angled leg 149 being aligned with the contact arm 113 and a further angled leg 150 being arranged at a distance and parallel to the contact arm 113. On the further angled leg 150, a further switching connection contact 145-3 is formed, which protrudes from the relay housing 129 and is adapted to be inserted into a contact plug in order to apply an electrical signal to the second contact surface 111-2.

The second contact surface 111-2 also has an offset section 147 which connects the angled legs 149, 150 and is adapted to arrange the two angled legs 149, 150 offset along the relay width or perpendicular to the support plane 117. Correspondingly, the angled leg 149 is arranged above the contact arm 113 and the further angled leg 150 is arranged in one plane, in particular the support plane 117 with the first contact surface 111-1. Correspondingly, a number of the respective fastening points of the first contact surface 111-1 and the second contact surface 111-2 are arranged in the support plane 117.

The relay 100 also has a further switch connection contact 145-2, which is arranged parallel to the switch connection contacts 145-1 and 145-3 and protrudes from the relay housing 129. The further switching connection contact 145-2 is electrically connected to the contact arm 113.

The relay 100 also has two relay connection contacts 143-1, 143-2, which are electrically connected to the electromagnetic coils 121-1, 121-2 in order to apply an electrical signal to the electromagnetic coils 121-1, 121-2.

Figure 2A:
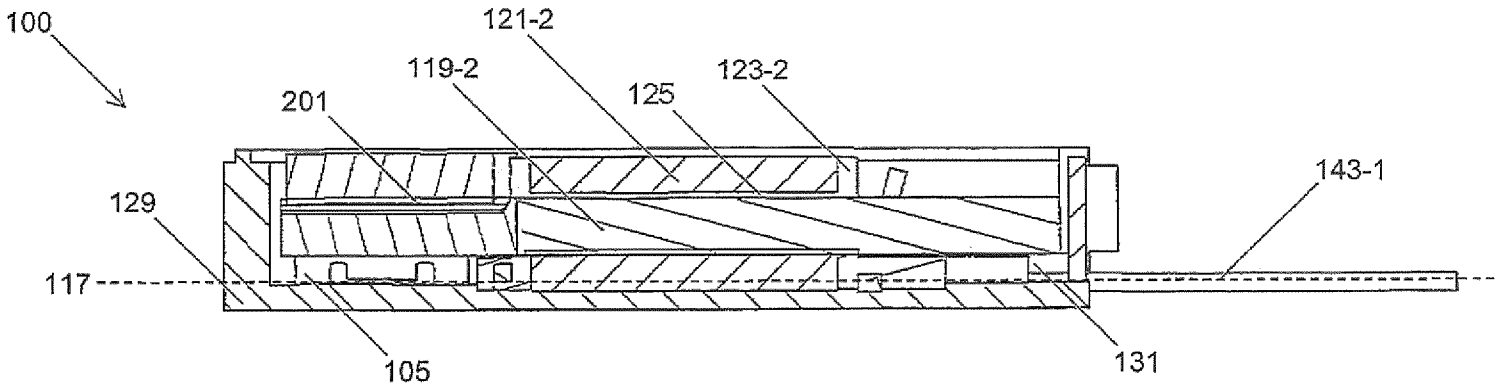
FIGS. 2*a*, 2*b* show a relay in an example.

FIG. 2*a* shows a schematic cross-sectional view of the relay 100, the cross-sectional plane running along the cutting plane 141 shown in FIG. 1. The relay 100 comprises a relay housing 129 which has a shell-shaped receiving niche 131 for receiving the electromagnetic drive arrangement 101 with the first yoke leg 119-1 and the second yoke leg 119-2.

The electromagnetic coil 121-2 is arranged with the coil carrier 123-2 on the second yoke leg 119-2. The yoke 107 is adapted to penetrate the armature 103 with a magnetic field generated by the electromagnetic coil 121-1 in order to generate the electromagnetic force. The coil carrier 123-2 has a recess 125 parallel to the support plane 117, in which the electromagnetic coil 121-2 engages on the second yoke leg 119-2 in order to reduce an width perpendicular to the support plane 117.

The armature 103 is arranged at a distance from the second yoke leg 119-2, so that a working gap 201 exists between the armature 103 and the second yoke leg 119-2. Under the effect of the electromagnetic force, the working gap 201 can be overcome by a movement of the armature 103, so that the armature 103 comes to rest on the second yoke leg 119-2. The relay connection contact 143-1 is also shown, which extends parallel to the support plane 117.

Figure 2B:
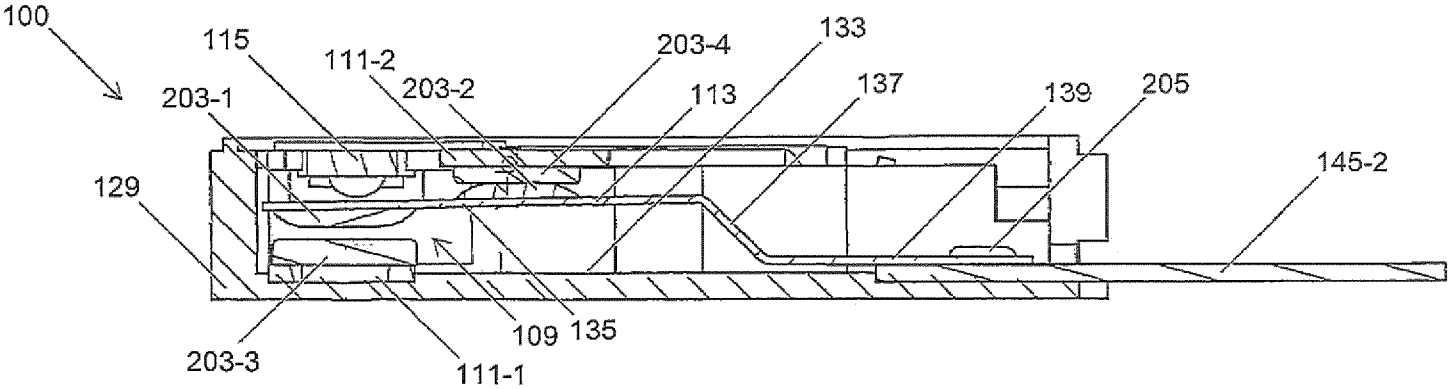

FIG. 2*b* shows a schematic cross-sectional view of the relay 100, the cross-sectional plane running along the cutting plane 127 shown in FIG. 1. The relay 100 comprises a relay housing 129, which has a shell-shaped receiving recess 131 for receiving the electromagnetic drive arrangement 101 with the insulating element 115 and the contact spring 109. With regard to the relay width, the first contact surface 111-1 is on a base surface 133 of the relay housing 129, wherein the contact arm 113 is arranged at a distance above the first contact surface 111-1 and the insulating element 115 is arranged above the contact arm 113.

The first contact surface 111-1 and the second contact surface 111-2 contact the contact arm 113 offset from one another. At contact surfaces of the first contact surface 111-1 and the second contact surface 111-2 with the contact arm 113 on the respective contact surface 111-1, 111-2 and on the contact arm 113 contact points 203-1, 203-2, 203-3, 203-4 are provided, which have an width in the direction of the relay width. Accordingly, an offset arrangement of the contact point 203-3 of the first contact surface 111-1 to the further contact point 203-4 of the second contact surface 111-2 an above each other arrangement of the contact point pairs 203-1, 203-3 and 203-2, 203-4 can be prevented. Correspondingly, the relay width is advantageously reduced with this arrangement of the contact points 203-1, 203-2, 203-3, 203-4.

The contact arm 113 has a contact section 135, a crank section 137 and a fastening section 139, the first contact surface 111 1 being arranged below the contact section 135 and the second contact surface 111-2 being arranged above the contact section 135. The contact section 135 is connected to the fastening section 139 via the crank section 137 and the crank section 137 is adapted to position the contact section 135 offset with respect to the fastening section 139 along an axis which is parallel to the relay width and perpendicular to the support plane 117. Furthermore, the switching contact connection 145-2 is connected in an electrically conductive manner to the fastening section 139 of the contact arm 113 via a rivet connection 205.

Figure 3:
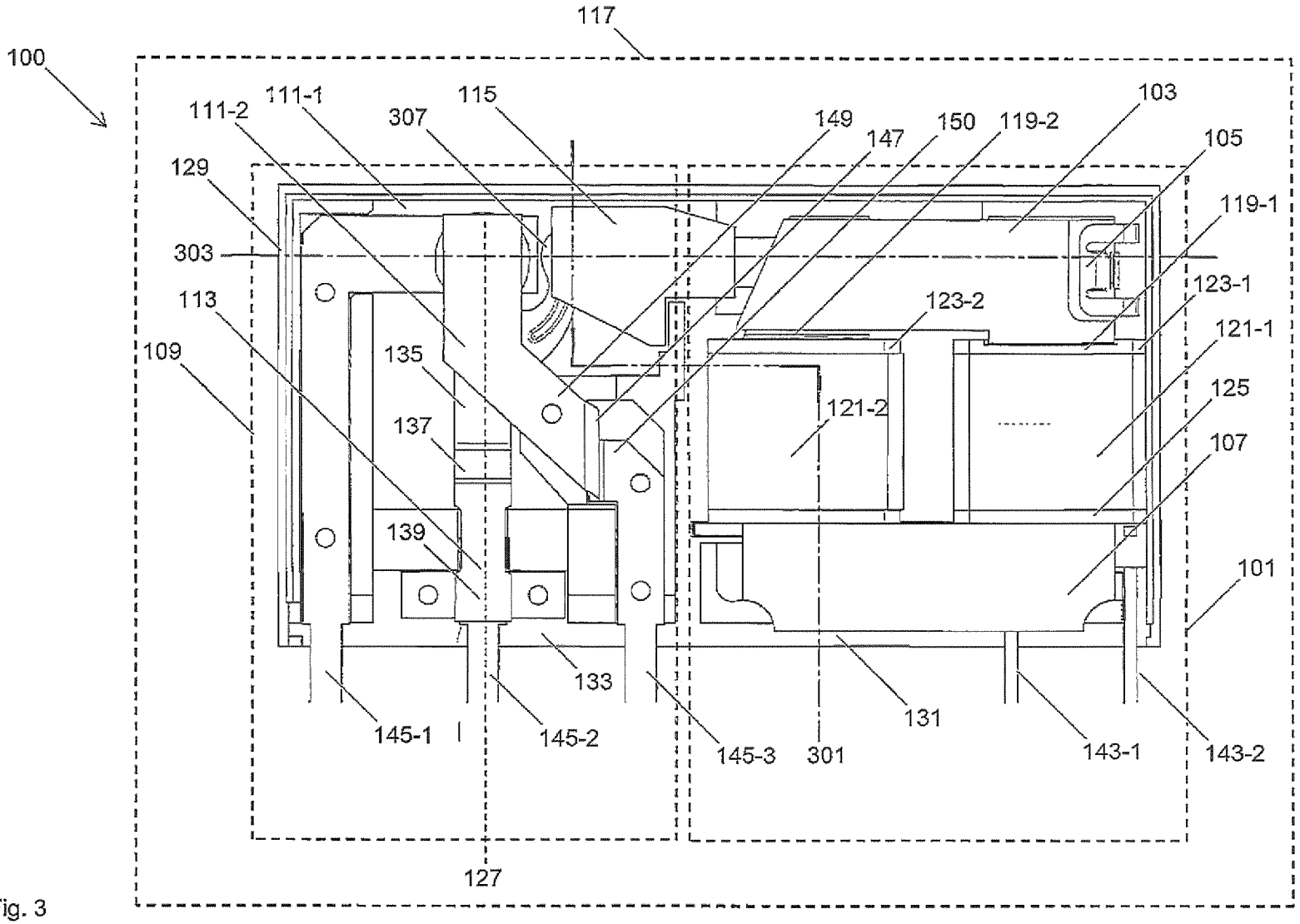
FIG. 3 shows a relay in an example.

FIG. 3 shows a schematic representation of a relay 100 for assembling in terminal blocks with reduced installation space. The relay 100 comprises an electromagnetic drive arrangement 101, which comprises an armature 103, an armature bearing spring 105 and a yoke 107. The armature 103 is mounted movably at least partially at a distance from the yoke 107.

The relay 100 further comprises a contact spring 109, which comprises a first contact surface 111-1, a second contact surface 111-2 and a contact arm 113. The contact arm 113 is arranged at a distance from the first contact surface 111-1. Furthermore, the relay comprises an insulating element 115 which is arranged on the armature 103 and lies on a receiving arm 307 of the contact arm 113. The insulating element 115 is adapted to electrically isolate the armature 103 from the contact arm 113 and to actuate the contact arm 113 via the receiving arm 307 in order to provide the pressure force acting on the contact arm 113 with a movement of the armature 103. The armature 103, the insulating element 115, the contact arm 113 and the yoke 107 are each arranged parallel to a support plane 117 and the armature 103, the insulating element 115 and the contact arm 113 are mounted in an at least partly movable manner perpendicularly with respect to the support plane 117.

The yoke 107 is U-shaped and comprises a first yoke leg 119-1 and a second yoke leg 119-2, the armature 103 being resiliently mounted on the first yoke leg 119-1 by means of the armature bearing spring 105. The first yoke leg 119-1 and the second yoke leg 119-2 are arranged in the support plane 117 and the armature 103 is arranged perpendicular to the first yoke leg 119-1 and the second yoke leg 119-2.

The relay 100 further comprises two electromagnetic coils 121-1, 121-2 and two coil carriers 123-1, 123-2. The electromagnetic coil 121-1 is arranged with the coil carrier 123-1 on the first yoke leg 119-1 and the further electromagnetic coil 121-2 is arranged with the further coil carrier 123-2 on the second yoke leg 119-2. The coil carriers 123-1, 123-2 each have a recess 125 parallel to the support plane 117, in which the respective electromagnetic coil 121-1, 121-2 engages on the respective yoke leg 119-1, 119-2, in order to reduce width perpendicular to the support plane 117.

The relay 100 further comprises a relay housing 129, which comprises a shell-shaped receiving niche 131 for receiving the electromagnetic drive arrangement 101 with the insulating element 115 and the contact spring 109. Furthermore, the contact arm 113 is oriented perpendicular to the armature 103 in a bearing direction 127, and the first contact surface 111-1 and the second contact surface 111-2 are oriented to one another along a common axis parallel to the support plane 117. Accordingly, there is a stacked arrangement of the spring contact switch 109 beginning with the first contact surface 111-1, which is arranged on a base surface 133 of the relay housing 129, the contact arm 113 lying on it or being spaced apart, and the second contact surface 111-2 lying on the contact arm 113 or being spaced apart.

The contact arm 113 comprises a contact section 135, a crank section 137 and a fastening section 139, the first contact surface 111 1 being arranged below the contact section 135 and the second contact surface 111-2 being arranged above the contact section 135. The contact portion 135 is connected to the fastening portion 139 via the offset portion 137 and the offset portion 137 is adapted to position the contact section 135 offset with respect to the fastening section 139 along an axis which is parallel to the relay width and perpendicular to the support plane 117.

Furthermore, the contact arm 113 comprises a receiving arm 307, which is formed laterally of the contact section 135 and/or the crank section 137, and the receiving arm 307 being adapted to at least partially receive the insulating element 115 in order to establish a form-fit and/or force-fit connection with the insulating element 115.

The first contact surface 111-1 is L-shaped, one end of the shorter leg being aligned with the contact arm 113. A switching contact connection 145-1, which protrudes from the relay housing 129, is molded onto the longer leg. The second contact surface 111-2 is angled, in particular z-shaped, with a first angled leg 149 being aligned with the contact arm 113 and a further angled leg 150 being arranged at a distance parallel to the contact arm 113. A further switching connection contact 145-3 is molded onto the further angled leg 150.

The second contact surface 111-2 also has an offset section 147 which connects the angled legs 149, 150 and is adapted to arrange the two angled legs 149, 150 offset along the overall relay width or perpendicular to the support plane 117. Correspondingly, the angled leg 149 is arranged above the contact arm 113 and the further angled leg 150 is arranged in one plane, in particular the support plane 117 with the first contact surface 111-1.

The relay 100 also has a further switch connection contact 145-2, which is arranged parallel to the switch connection contacts 145-1 and 145-3 and protrudes from the relay housing 129. The further switching connection contact 145-2 is electrically connected to the contact arm 113.

The relay 100 also has two relay connection contacts 143-1, 143-2, which are electrically connected to the electromagnetic coils 121-1, 121-2 in order to apply an electrical signal to the electromagnetic coils 121-1, 121-2.

Figure 4A:
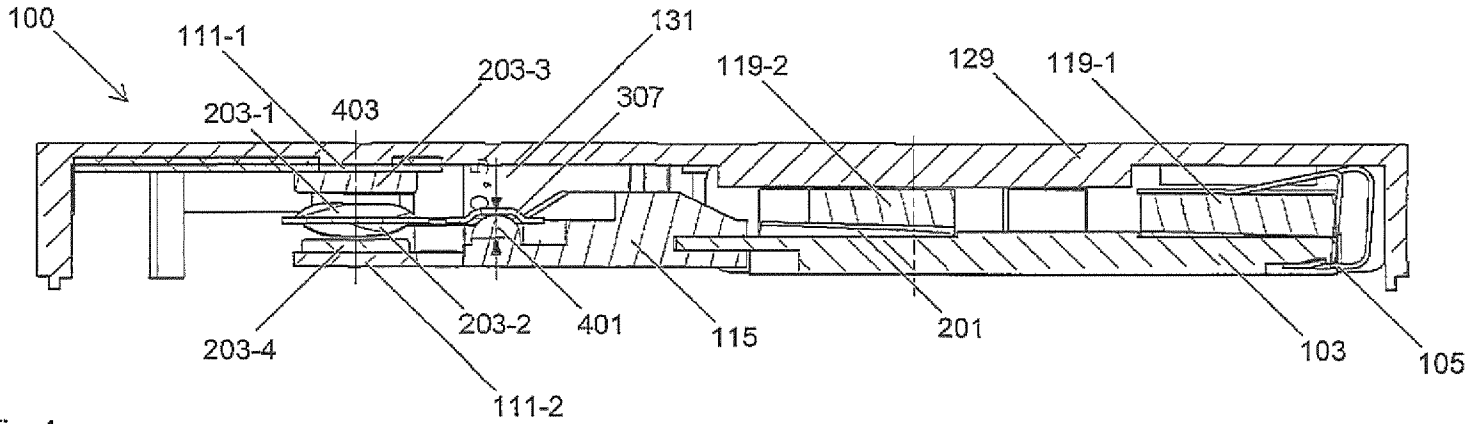
FIGS. 4*a*, 4*b* show a relay in an example.

FIG. 4*a* shows a schematic cross-sectional view of the relay 100, the cross-sectional plane running along the cutting line 301 shown in FIG. 3. The relay 100 comprises a relay housing 129 which has a shell-shaped receiving recess 131 for receiving the electromagnetic drive arrangement 101 with the first yoke leg 119-1 and the second yoke leg 119-2.

The armature 103 is arranged at a distance from the second yoke leg 119-2 and partially from the first yoke leg 119-1, so that the working gap 201 exists between the armature 103 and the second yoke leg 119-2. Under the effect of the electromagnetic force, the working gap 201 can be overcome by a movement of the armature 103, so that the armature 103 comes to rest on the second yoke leg 119-2.

The first contact surface 111-1 and the second contact surface 111-2 contact the contact arm 113 congruently with one another. On contact surfaces of the first contact surface 111-1 and the second contact surface 111-2 with the contact arm 113, there are contact points 203-1, 203-2, 203-3, 203 provided on the respective contact surface 111-1, 111-2 and on the contact arm 113-4, which have a width in the direction of the relay width. Here, an width of the contact spring 109 falls below the relay width. The contact point pairs 203-1, 203-3 and 203-2, 203-4 have a common axis of symmetry 403.

The receiving arm 307 comprises a recess into which a coupling element 401 of the insulating element 115 engages in order to realize a form-fit connection between the insulating element 115 and the contact arm 113. The insulating element 115 and the second contact surface 111-2 do not exceed a maximum height of the armature 103 in the direction of the relay height, so that the second contact surface 111-2 and the insulating element 115 do not increase the relay structural height.

Figure 4B:
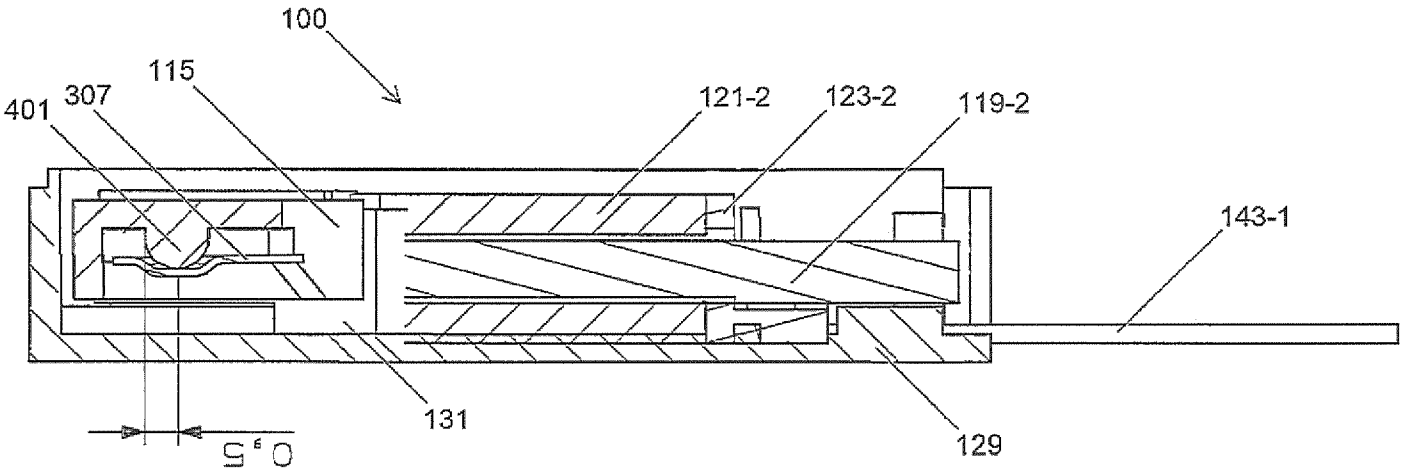

FIG. 4*b* shows a schematic cross-sectional view of the relay 100, the cross-sectional plane running along the section line 303 shown in FIG. 3. The relay 100 comprises a relay housing 129 which has a shell-shaped receiving niche 131 for receiving the electromagnetic drive arrangement 101 with the second yoke leg 119-2. The coupling element 401 is hemispherical in shape and engages in a recess in the receiving arm 307. The coupling element 401 and the recess of the receiving arm 307 each have a radius of 0.5 mm.

The electromagnetic coil 121-2 is arranged on the coil carrier 123-2 and encloses the second yoke leg 119-2 in a cylindrical shape. Furthermore, the relay connection contact 143-1 is shown, with which the electromagnetic coil 121-2 can be supplied with an electrical signal.

Figure 5:
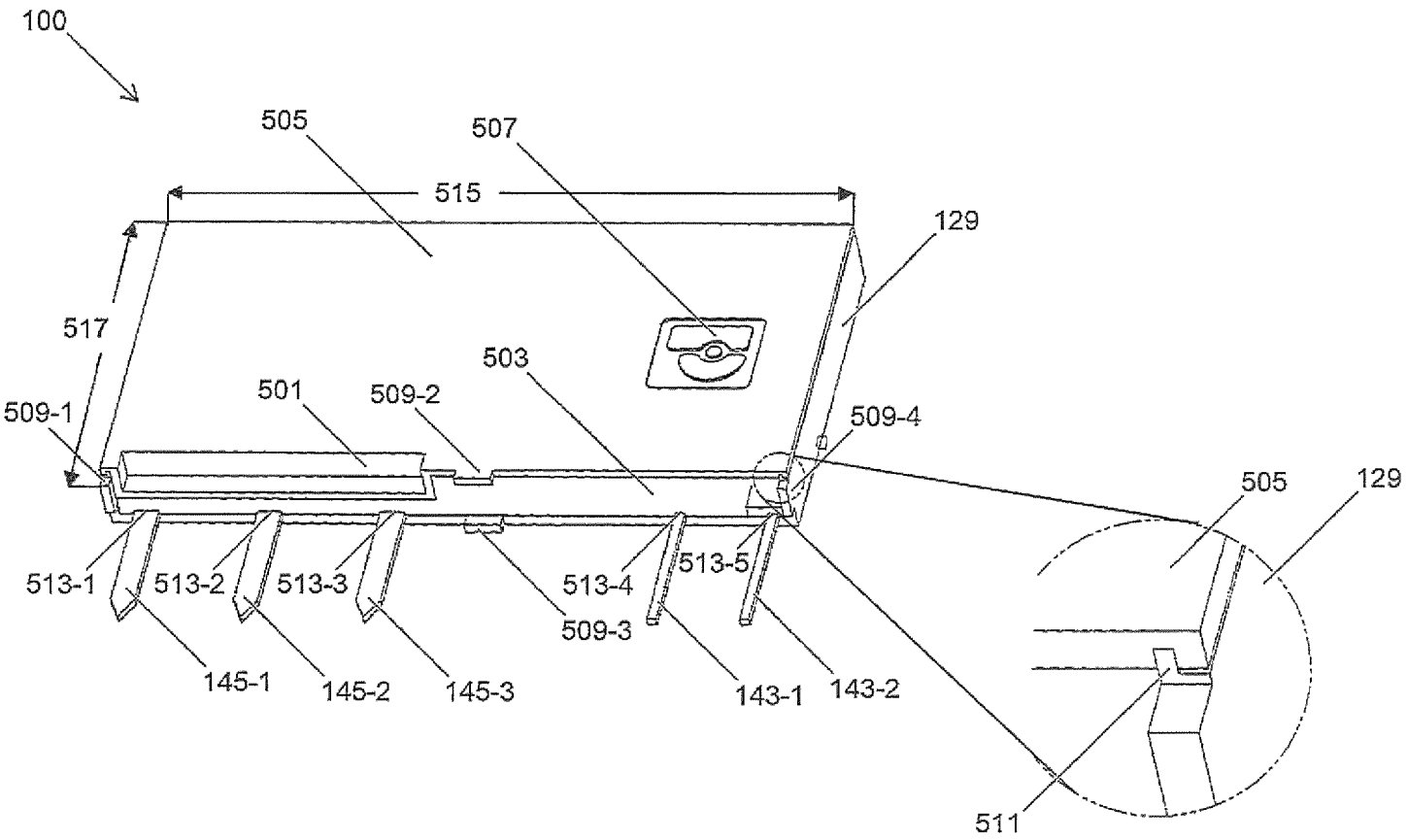
FIG. 5 shows a relay in an example.

FIG. 5 shows a schematic representation of the relay 100 with a relay housing 129, which is in particular trough-shaped and open in the direction of the relay connection contacts 143-1, 143-2 and the switching contact connections 145-1, 145-2, 145-3. A side wall 505, which laterally closes off the relay housing 129, is also arranged on the relay housing 129. In the area of the switching connection contacts 145-1, 145-2, 145-3, the side wall 505 has a recess 501 with which in particular the insulation and leakage distances between relays 100 arranged next to one another in the area of the switching connection contacts 145-1, 145-2, 145-3 can be increased, in particular without increasing a respective relay width.

The composite of relay housing 129 and side wall 505 is closed by the base plate 503, so that relay housing 129 with side wall 505 and base plate 503 has a closed interior. The abutting edges between the base plate 503 with the side wall 505 and the relay housing 129 can in particular be sealed in order to seal the relay housing 129 against dust, moisture or other environmental influences.

Fastening elements 509-1, 509-2, 509-4 are formed on the relay housing 129 and a fastening element 509-3 is formed on the side wall 505. The fastening elements 509-1, 509-2, 509-3, 509-4 can in particular be latching lugs, barbs, snap-in connectors, clamp connectors and/or plug connectors. Furthermore, the fastening elements 509-1, 509-2, 509-3, 509-4 can be used to define a distance between the base plate 503 and a relay plug-in connector, so that after the relay 100 has been plugged into the relay plug-in connector, which is in particular a terminal block, a gap is formed between the relay housing 129 and the relay plug connector.

The relay housing 129, the side wall 505 and the base plate 503, which is offset in particular with respect to the relay housing 129 and the side wall 505 in the direction of the interior of the relay housing 129, can form a trough on the connection contact side. This through can be filled with a flowable insulating material or sealing material in order to seal off the relay housing 129, the switching connection contacts 145-1, 145-2, 145-3 and/or the relay connection contacts 143-1, 143-2. The insulating or sealing material can harden after filling in order to produce a firm and/or elastic seal of the relay 100.

The base plate 503 has contact receiving niches 513-1, 513-2, 513-3, 513-4, 513-5, into which the switching connection contacts 145-1, 145-2, 145-3 respectively the relay connection contacts 143-1, 143-2 engage. The side wall 505 also has an embossing 507. The relay housing 129 also has a form-fitting connector 511 which engages in a guide groove in the side wall 505 and connects the side wall 505 to the relay housing 129 in a form-fitting manner. The form-fit connection of the side wall 505 to the relay housing 129 by means of the form-fit connector 505 can in particular run around the circumference of the side wall 505. Furthermore, the form-fit connection can be sealed by introducing a sealant. The form-fit connector 511 is L-shaped and is formed in one piece with the relay housing 129.

The relay 100 in particular has an overall relay length 515 which is defined along a line parallel to a connecting line of the switching connection contacts 145-1, 145-2, 145-3 and/or a longitudinal edge of the relay housing 129. The relay length 515 is in particular 28 mm. Furthermore, the relay has an overall relay height 517 which is defined along a further longitudinal edge of the relay housing 129 and in particular can enclose the fastening element 509-1. The overall relay height 517 is in particular 15 mm to 15.5 mm.

Figure 6A:
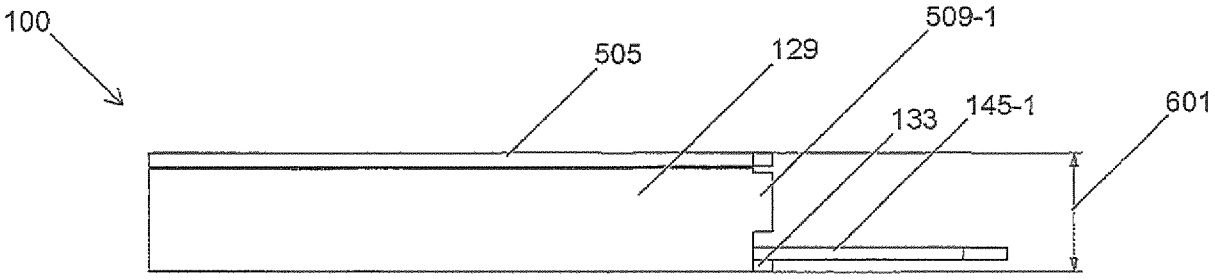
FIGS. 6*a*, 6*b* show a relay in one example.

FIG. 6*a* shows a schematic side view of the relay according to the example shown in FIG. 5. A relay width 601 is defined via a width of the relay housing 129 and via a width of the side wall 505. The overall relay width 601 is in particular 3 mm. The relay housing 129 has a fastening element 509-1, which is formed in one piece with the relay housing 129. The switch contact connection 145-1 lies on the base area 133 of the relay 100.

Figure 6B:
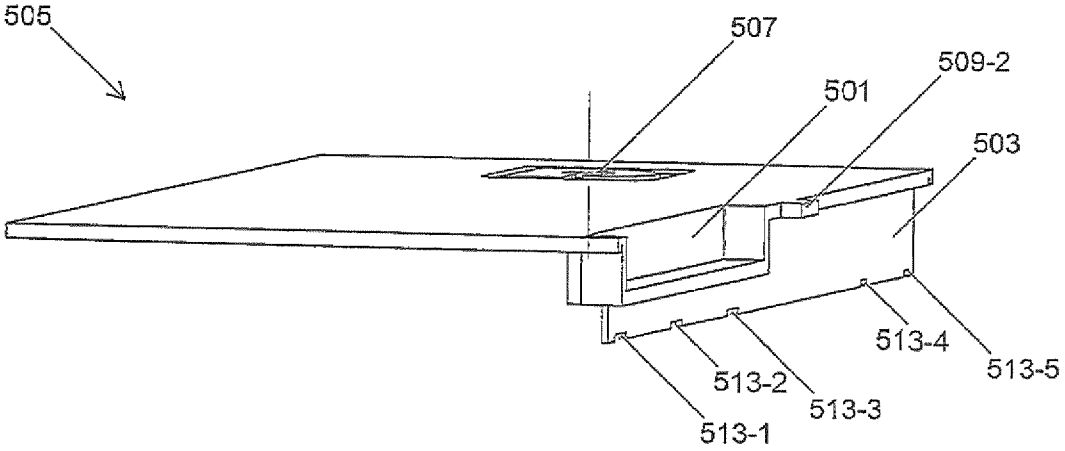

FIG. 6*b* shows a schematic perspective view of the side wall 505 with the bottom wall 503. The recess 501 forms a step which closes off with side walls and which protrudes into the interior of the relay housing 129. The bottom wall 503 is attached to the side wall 505 perpendicularly. The side wall 505 also has an indentation 507. The fastening element 509-2 is attached to the side wall 505 in a plane in one plane. The base plate 503 has contact receiving niches 513-1, 513-2, 513-3, 513-4, 513-5, with which switching connection contacts and/or relay contacts of the relay can be led to the outside.

Figure 7:
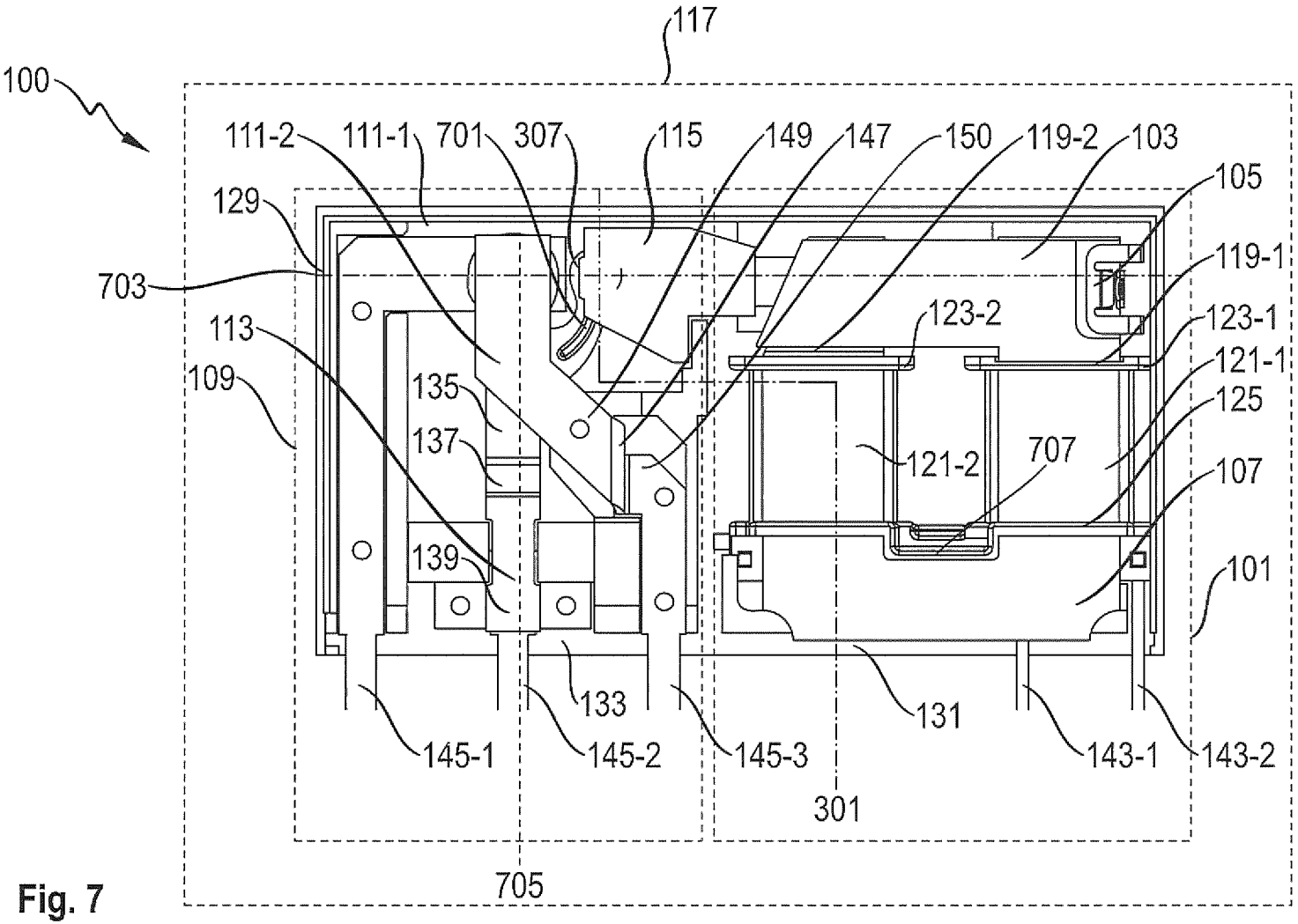
FIG. 7 shows a relay in an example.

FIG. 7 shows a schematic illustration of a relay 100 according to the example shown in FIG. 3. The contact arm 113 has a receiving arm 307 which is formed laterally on the contact section 135 and/or the crank section 137. The receiving arm 307 has an opening 701 which is adapted to at least partially receive the insulating element 115 in order to form a form-fit and/or force-fit connection with the insulating element 115. The insulating element 115 can at least partially penetrate the, in particular elongated hole-shaped opening 701. The opening 701 can be formed, for example, by an embossing in the receiving arm 307.

The coil carriers 123-1 and the further coil carrier 123-2 are connected to one another via a connecting element 707. The coil carriers 123-1, 123-2 can be formed in one piece with the connecting element 707.

Figure 8A:
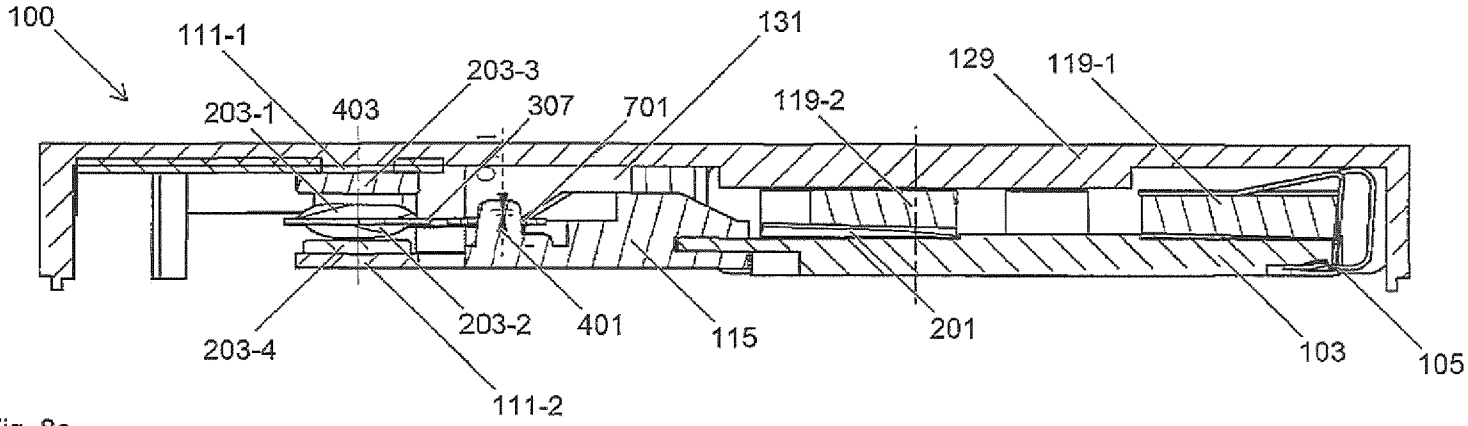
FIGS. 8*a*, 8*b* show a relay in an example.

FIG. 8*a* shows a schematic cross-sectional view of the relay 100 according to the example shown in FIG. 7, the cross-sectional plane running along the section line 703 shown in FIG. 7. The receiving arm 307 has an opening 701 into which a coupling element 401 of the insulating element 115 engages in order to realize a form-fit connection between the insulating element 115 and the receiving arm 307. The coupling element 401 is cylindrical and/or conically shaped and is adapted to pass through the opening 701 in order to realize a force and/or form-fit connection between the insulating element 115 and the receiving arm 307. After the coupling element 401 has been inserted into the opening 701, in particular such that the coupling element 401 penetrates the opening 701, the coupling element 401 protrudes in the direction of the relay housing 129. The coupling element 401 can be anchored in the opening 701 by means of a snap-in connection in order to prevent the connection between the insulating element 115 and the receiving arm 307 from being released. The protrusion can be in a range from 0.05 to 0.5 mm.

Figure 8B:
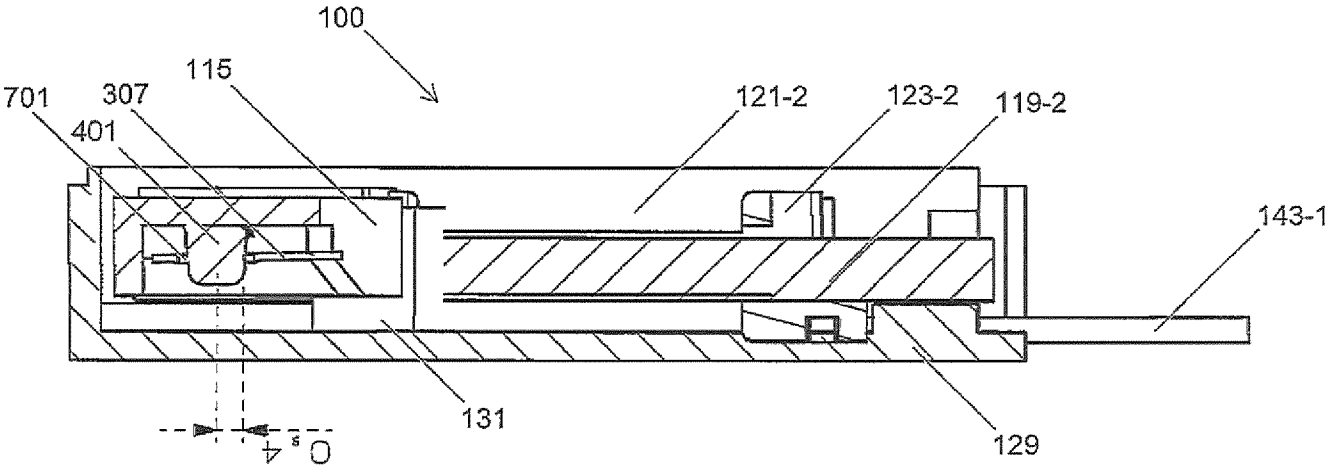

FIG. 8*b* shows a schematic cross-sectional view of the relay 100, the cross-sectional plane running along the cutting line 705 shown in FIG. 7. The coupling element 401 has a cross-section which tapers in the direction of the insulating element 115. The coupling element 401 can in particular be conical, trapezoidal, pyramid-shaped or pin-shaped in order to engage in the opening 701 in a form-fitting manner. The opening 701 of the receiving arm 307 has a radius in a range of 0.1 to 1 mm in a contact area with the opening 701.

LIST OF REFERENCE SYMBOLS

100 relay
101 electromagnetic drive assembly
103 armature
105 armature bearing spring
107 yoke
109 contact spring

111-1 first contact surface
111-2 second contact surface
113 contact arm
115 insulating element
117 Support plane
119-1 first yoke leg
119-2 second yoke leg
121-1 electromagnetic coil
121-2 electromagnetic coil
123-1 coil carrier
123-2 coil carrier
125 recess
127 position direction
129 relay housing
131 receiving niche
133 base area
135 contact section
137 crank section
139 fastening section
141 cutting plane
143-1 relay connection contact
143-2 relay connection contact
145-1 switching contact connection
145-2 switching contact connection
145-3 switching contact connection
147 offset section
201 working gap
203-1 contact point
203-2 contact point
203-3 contact point
203-4 contact point
205 riveted connection
301 cutting plane
303 cutting plane
307 support arm
401 coupling element
403 axis of symmetry
501 recess
503 base plate
505 side wall
507 embossing
509-1 fastening element
509-2 fastening element
509-3 fastening element
509-4 fastening element
509-5 fastening element
511 form-fitting connector
513-1 receiving niche
513-2 receiving niche
513-3 receiving niche
513-4 receiving niche
513-5 receiving niche
515 relay length
517 relay height
601 relay width
701 opening
703 section plane
705 section plane
707 connector

What is claimed is:

1. A relay for assembling in terminal blocks with a reduced installation space, comprising:

an electromagnetic drive arrangement comprising an armature, an armature bearing spring, and a yoke, wherein the armature is at least partially spaced from the yoke, is movably mounted, and is configured to reduce a distance between the yoke and the armature under an effect of an electromagnetic force acting on the armature;

wherein the armature bearing spring is configured to apply a spring force to the armature counteracting the electromagnetic force;

wherein the yoke is configured to interact electromagnetically with the armature to apply the electromagnetic force to the armature;

a contact spring comprising a first contact surface and a contact arm, wherein the contact arm is arranged at a distance from the first contact surface and configured to come into contact with the first contact surface via a pressure force acting on the contact arm such that an electrical connection is established between the first contact surface and the contact arm; and an insulating element which is arranged on the armature and lies on the contact arm, wherein the insulating element is configured to electrically isolate the armature from the contact arm and to actuate the contact arm to produce the pressure force which acts on the contact arm by moving the armature;

wherein the armature, the insulating element, the contact arm, and the yoke are each arranged parallel to a support plane, and wherein the armature, the insulating element, and the contact arm are mounted such that the armature, the insulating element, and the contact arm are at least partially moveable perpendicularly with respect to the support plane.

2. The relay according to claim 1, wherein the contact arm is configured to elastically deform when the pressure force acts perpendicular to the support plane such that a spring tensioning force which counteracts the pressure force is generated.

3. The relay according to claim 2, wherein the contact arm is configured to separate the electrical connection of the contact arm with the first contact surface if the spring tensioning force is greater than the pressure force.

4. The relay according to claim 1, wherein the contact arm is arranged perpendicular to the insulating element.

5. The relay according to claim 1, wherein the yoke is U-shaped and comprises a first yoke leg and a second yoke leg, and wherein the armature is at least partially resiliently mounted on the first yoke leg via the armature bearing spring and is arranged at a distance from the second yoke leg, and wherein the first yoke leg and the second yoke leg are arranged in the support plane and the armature is arranged perpendicular to the first yoke leg or the second yoke leg.

6. The relay according to claim 5, wherein the armature is paramagnetic or ferromagnetic such that when the electromagnetic force acts, a distance between the armature and the second yoke leg is reduced along a perpendicular of the support plane by a movement of the armature towards the second yoke leg or by a deformation of the armature in a direction of the second yoke leg.

7. The relay according to claim 1, further comprising an electromagnetic coil and a coil carrier, wherein the electromagnetic coil is arranged with the coil carrier on the yoke, wherein the electromagnetic force is from a magnetic field generated by the electromagnetic coil, and wherein the yoke is configured to allow the magnetic field to penetrate the armature.

8. The relay according to claim 7, wherein the coil carrier comprises a recess parallel to the support plane in which the electromagnetic coil at least partially engages on the yoke to reduce a width perpendicular to the support plane.

9. The relay according to claim 1, wherein the contact spring comprises a second contact surface, and wherein the contact arm is arranged on the second contact surface and is configured to electrically separate the second contact surface from the contact arm under an effect of the pressure force.

10. The relay according to claim 9, wherein the contact arm is configured to restore the electrical connection of the contact arm to the second contact surface after the pressure force has subsided.

11. The relay according to claim 9, wherein the contact arm is oriented perpendicular to the armature in a position direction, the first contact surface being at a smaller distance from the insulating element than the second contact surface along the position direction.

12. The relay according to claim 1, further comprising a relay housing comprising a shell-shaped receiving niche configured to receive the electromagnetic drive arrangement with the insulating element and the contact spring, wherein the contact spring is arranged laterally next to the yoke to reduce a relay width of the relay.

13. The relay according to claim 12, wherein the first contact surface is on a base surface of the relay housing, and wherein in relation to the relay width, the contact arm is arranged at a distance above the first contact surface and the insulating element is arranged above or next to the contact arm.

14. The relay according to claim 1, wherein the contact arm comprises a contact section, a crank section, and a fastening section, wherein the first contact surface is arranged on the contact section, and wherein the contact section is connected to the fastening section via the crank section, and wherein the crank section is configured to position the contact section in relation to the fastening section offset along an axis which is perpendicular to the support plane.

15. The relay according to claim 14, wherein the contact arm comprises a receiving arm which is formed laterally on the contact section or the crank section, the receiving arm being configured to at least partially receive the insulating element to form a form-fit or force-fit connection with the insulating element.

* * * * *